US008201280B1

(12) United States Patent
Nally, Jr.

(10) Patent No.: US 8,201,280 B1
(45) Date of Patent: Jun. 19, 2012

(54) ARRANGEMENT FOR PROTECTING A WASTE WATER LINE

(76) Inventor: Harry Barnett Nally, Jr., Taylorsville, KY (US)

( * ) Notice: Subject to any disclaimer, the term of this patent is extended or adjusted under 35 U.S.C. 154(b) by 282 days.

(21) Appl. No.: 12/406,672

(22) Filed: Mar. 18, 2009

Related U.S. Application Data

(60) Provisional application No. 61/039,811, filed on Mar. 27, 2008.

(51) Int. Cl.
*E03D 11/00* (2006.01)

(52) U.S. Cl. ..... 4/256.1

(58) Field of Classification Search ..... 4/255.01, 4/256.1; 210/131, 162, 446–447; 43/66; 137/41; 15/104.32
See application file for complete search history.

(56) References Cited

U.S. PATENT DOCUMENTS 2,693,603 A * 11/1954 Lehmann ..... 4/256.1
2,733,816 A * 2/1956 Griffith ..... 210/767
2,811,724 A * 11/1957 Click et al. ..... 4/256.1
4,555,818 A * 12/1985 Harrington ..... 4/256.1
6,668,389 B1 * 12/2003 Steinmetz et al. ..... 4/256.1

* cited by examiner

*Primary Examiner* — Charles Phillips
(74) *Attorney, Agent, or Firm* — Camoriano and Associates; Theresa Fritz Camoriano

(57) ABSTRACT

An arrangement for protecting a waste water line from plugging due to debris includes a pipe with spikes projecting upstream toward the oncoming waste water flow.

15 Claims, 8 Drawing Sheets

ARRANGEMENT FOR PROTECTING A WASTE WATER LINE

BACKGROUND

This application claims priority from U.S. application Ser. No. 61/039,811, filed Mar. 27, 2008, which is hereby incorporated herein by reference.

The present invention relates to a device for protecting a waste water line from debris which it is not intended to handle. When debris which may otherwise clog a waste water line is flushed down a toilet, the device intercepts it for easy and quick removal before the debris travels farther along the waste water line making it more difficult to remove, and it does so without interfering with the passage of normal waster into the waste waterline.

There is a continual problem in jails and prisons with inmates intentionally flushing debris down their toilets and plugging up the Waste water system. They may flush clothing, sheets, or anything else they can find. The debris that is inserted into one toilet usually passes down into the common waste line where it plugs up the waste line for several toilets. This causes a back-up of the waste line, with flooding that can do serious damage, including flooding of the building on floors below the level of the toilet where the problem originated. The cost to replace carpets, ceilings, wallboards, documents, and computers from such flooding can be very expensive. It is also expensive to have to regularly call out plumbers to unplug the waste lines and retrieve debris that is wedged a long distance into the waste line.

DESCRIPTION

Figure 1:
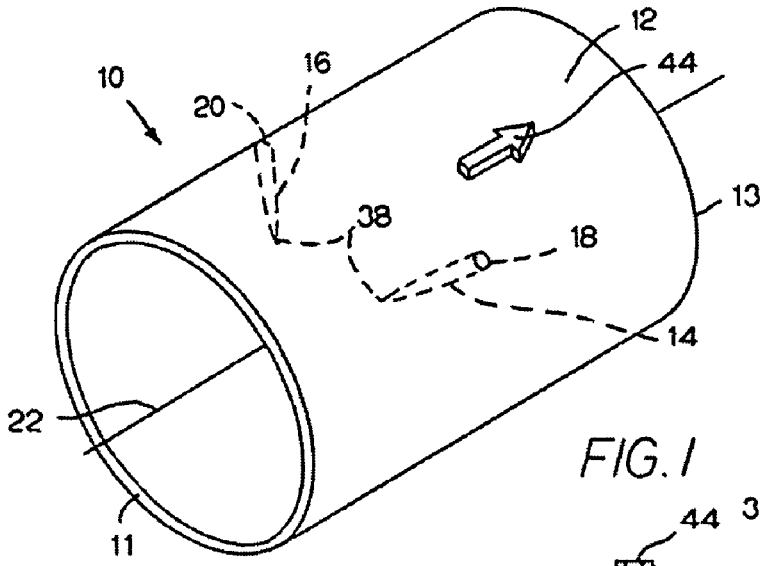
FIG. 1 is a perspective view of a waste water line protection device made in accordance with the present invention.

The protection device 10 of FIGS. 1-3 and 5-7 includes a hollow cylindrical pipe wall 12, which, in this embodiment, is six inches long and four inches in inside diameter. The pipe wall 12 defines an upstream end 11 and a downstream end 13. Two spikes 14, 16 project inwardly and upstream from points on the inner surface of the pipe wall 12 that are about two inches in from the upstream end 11 of the pipe 12, into which the waste water enters. Each spike 14, 16 is approximately ¾" to 1-⅛" long.

Figure 2:
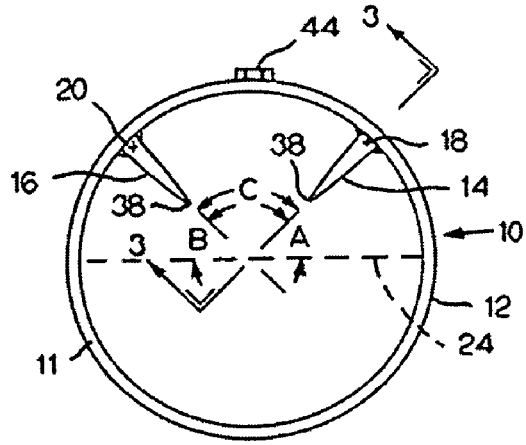
FIG. 2 is an end view of the waste water line protection device of FIG. 1.
Figure 3:
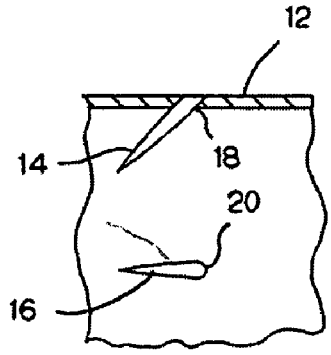
FIG. 3 is a view along line 3-3 of FIG. 2.

As shown in FIG. 2, the spikes 14, 16 are welded to the pipe 12 at points 18, 20 that lie at 10:00 and 2:00 positions (so the angles A and B are each 30 degrees from an imaginary horizontal diameter 24 extending through the axis 22 of the pipe. This means that the angle C defined by radii extending to the points 18, 20 is 120 degrees. It is preferred that the angle C be at least thirty degrees, more preferable that it be at least ninety degrees, and most preferable that it be between 110 degrees and 130 degrees. The tips 38 of the spikes 14, 16 also lie at the same angle C relative to each other. In this embodiment, the points 18, 20 are identical to each other and lie in the same vertical plane 40 perpendicular to the longitudinal axis 22 (see FIG. 11). it is preferable that they lie in close to the same vertical plane, so that their tips 38 also lie in nearly the same vertical plane and can function together to catch debris. It is estimated that the tips 38 of the spikes 14, 16 should lie in vertical planes that are within two inches of each other, preferably within one inch, and most preferably within one-half inch in order to perform most effectively. The tips 38 are free and pointed, so that can snag clothing or sheets or other debris that is inserted into the wastewater line.

Figure 11:
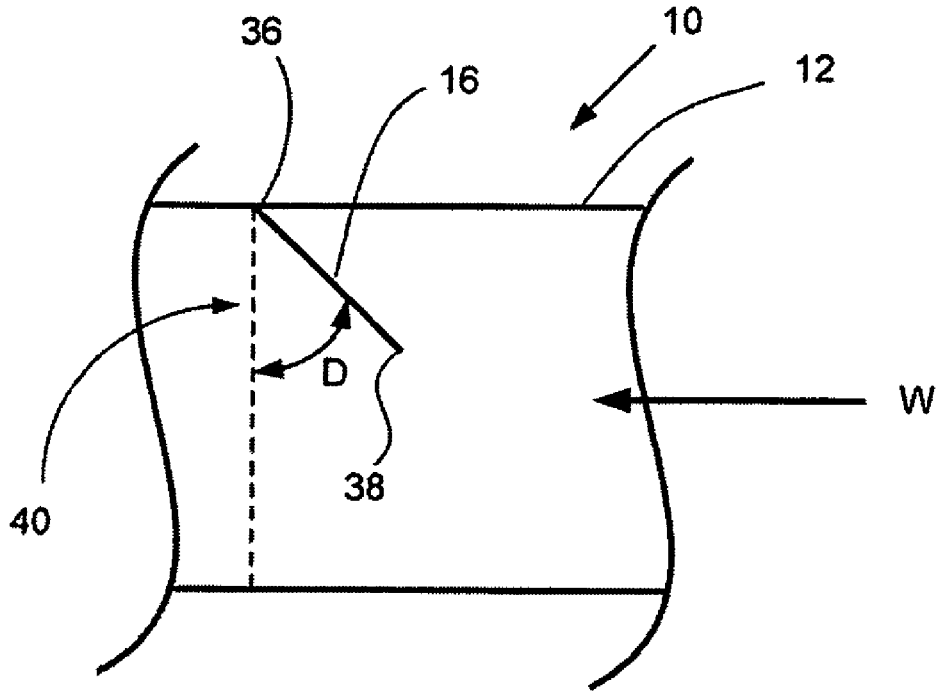
FIG. 11 is a schematic view, along line 11-11 of FIG. 10.

As best appreciated in FIG. 11, the spikes 14, 16 are directed at an upstream angle D of 45 degrees from the vertical toward the oncoming waste flow W. It is preferred that the upstream angle D from the base 36 of the spike (at the inner surface of the pipe wall 12) to the tip 38 of the spike be at least twenty degrees, more preferable that it be at least thirty degrees, and most preferable that it be at least forty degrees.

The spikes 14, 16 have a larger cross-sectional area at their base 36 (at the points 18, 20 where they secure to the pipe wall 12) than at their tips 38, and the tips 38 preferably are sharpened to a point in order to help snag the debris. Since these spikes 14, 16 are directed toward the oncoming waste flow W and are sharp at the tips 38, they will catch or snag sheets, clothing, or other debris 26 (See FIG. 7) that is flushed down the toilet, preventing it from passing further down into the waste line. Also, since the spikes 14, 16 only project part-way into the pipe 12, preferably terminating in the top half of the interior space defined by the pipe wall 12, which is the space above the horizontal diameter line 24 (as shown in FIG. 2), they leave a large portion of the lower part of the pipe 12 from and open to permit the free flow of normal waste. The spikes 14, 16 preferably extend inwardly from the inner surface of the pipe wall 12 a distance that is from 20% to 40% of the inside diameter of the pipe wall 12.

Figure 8:
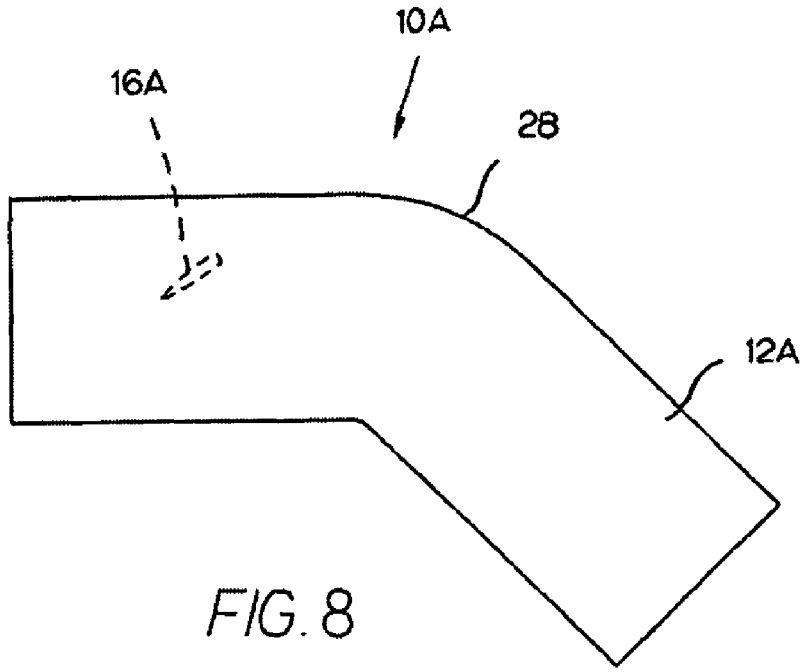
FIG. 8 is a side view of another embodiment of a waste water line protection device installed in a 45 degree elbow fitting.
Figure 9:
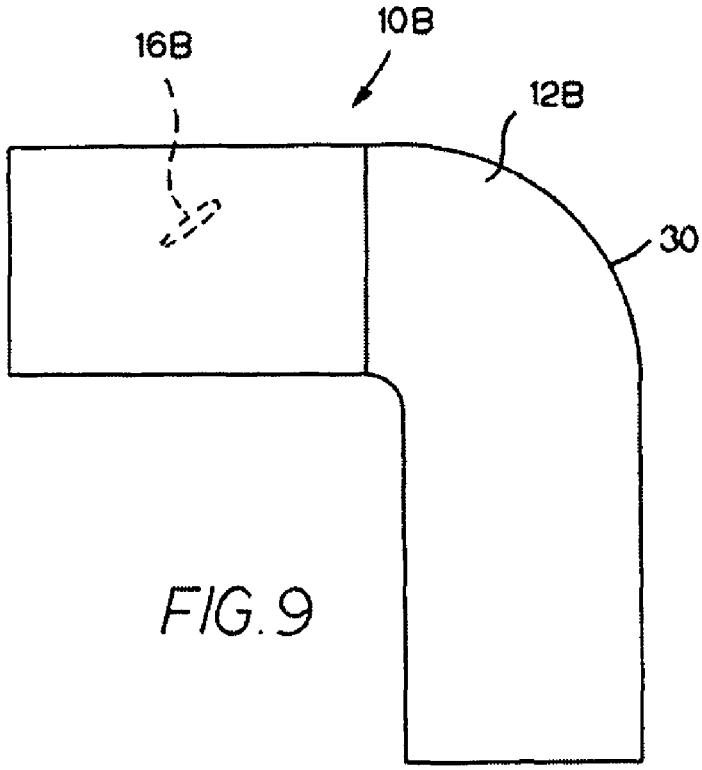
FIG. 9 is a side view of another embodiment of a waste water line protection device installed in a 90 degree elbow fitting.

FIG. 8 shows an alternative embodiment of a device 10A, which is the same as the device 10, except that the pipe 12A includes a 45 degree bend or elbow 28. Similarly, FIG. 9 shows another alternative embodiment of a device 10B, wherein the pipe 12B includes a ninety-degree elbow 30. The plumber will select the embodiment that fits the installation best in order to connect the waste line of the toilet into the waste line of the building's waste system. In both of these embodiments, the spikes 14, 16 extend from the 10:00 and 2:00 positions at an upstream angle of 45 degrees toward the incoming flow W of waste as described with respect to the first embodiment 10.

Figure 4:
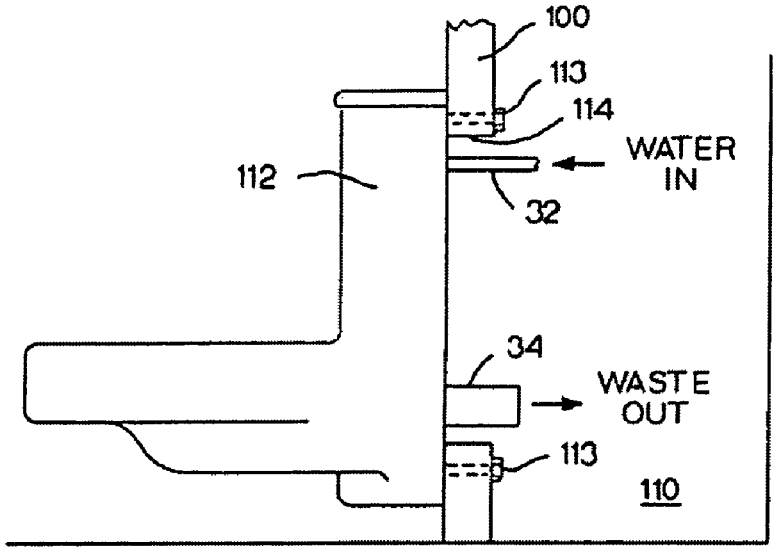
PRIOR ART FIG. 4
FIG. 4 is a side View of a typical toilet installation in a facility such as in a prisons or correctional facility.

FIG. 4 shows a typical toilet installation in a correctional facility. There is a long wall 100, with a hallway or chase area 110 to the right of the wall, and toilets 112 are mounted at intervals along that wall 100, one behind the other. There is a small opening 114 in the wall 100 at each toilet 112 which permits the water line 32 which is upstream of the toilet, and the waste water line 34, which extends downstream from the toilet, to extend through the wall 100. The toilets 112 are securely bolted to the wall 100 by means of bolts 113 (which are not accessible from inside the cell) and cover the openings 114.

Figure 5:
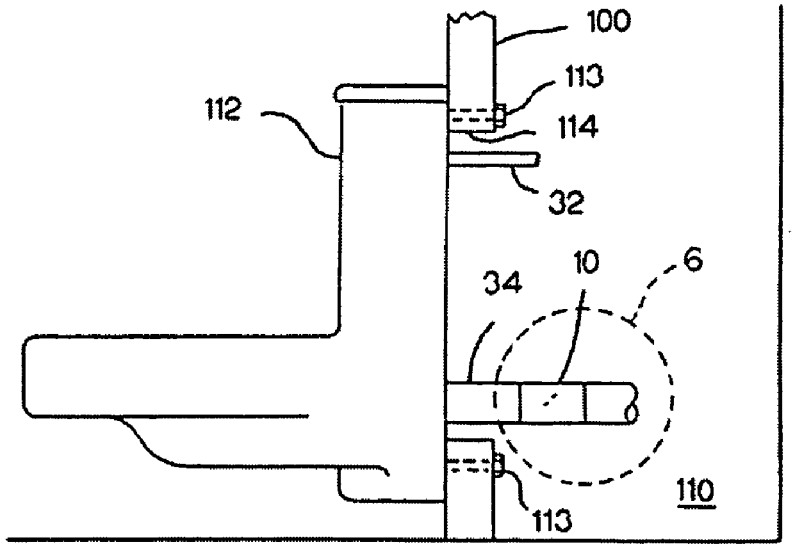
FIG. 5 is a view similar to that of FIG. 4, but with a waste water line protection device added to the installation.
Figure 6:
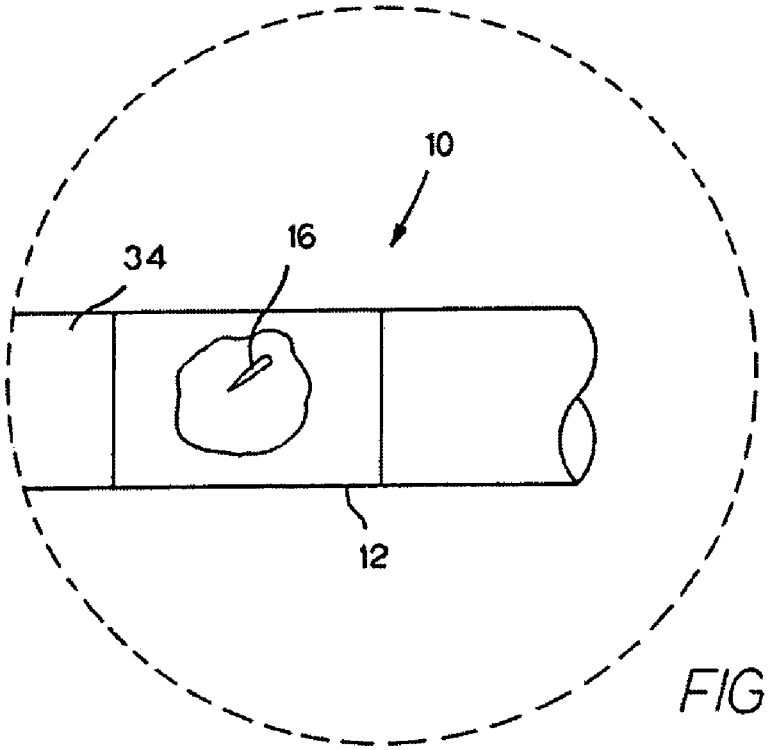
FIG. 6 is a partially broken away, enlarged view of the detail 6 of FIG. 5, showing the waste water line protection device.
Figure 7:
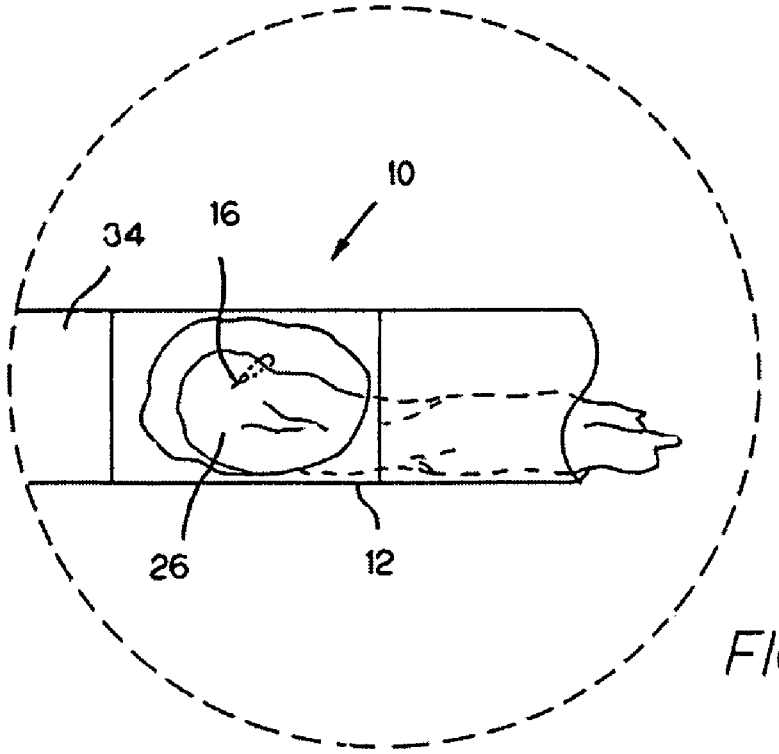
FIG. 7 is a view similar to that of FIG. 6, but showing some debris which has been intercepted by the waste water line protection device.

As shown in FIG. 5, the protection device 10 is mounted in line with the waste water line 34 directly behind the toilet 112, with the spikes 14, 16 directed upstream toward the incoming waste flow and the bases of the spikes 14, 16 located at the 2:00 and 10:00 positions, as shown in FIG. 2. The pipe wall 12 is a structurally independent member, which, for the purpose of this specification, means that it is a separate piece from the toilet 112, so that it can be placed downstream of the outlet pipe 34 that extends rearwardly from the toilet and through the wall 100 behind the toilet 112. The spikes 14, 16 are located entirely in the top half of the interior space defined by the pipe wall 12. The tips 38 of the spikes preferably are less than five feet away from the back of the toilet 112 and more preferably less than three feet away from the back of the toilet 112, in order to make it easy to reach the debris that they catch with an auger inserted into the toilet 112.

Because there are no spikes or other projections in the bottom half of the interior space defined by the pipe wall 12, leaving the bottom half of the interior space free and open, the device allows for the flow of normal waste through the waste line 34 without any interference. In addition, the spikes 14, 16 will catch any debris 26 that a prisoner flushes down the toilet 112 directly behind that single toilet 112, before the debris 26 enters any common waste line. This is advantageous for several reasons.

First, the debris 26 can be removed very easily using a hand-held toilet auger, which can be handled by the building's maintenance personnel, without having to call a plumber. Second, since the debris 26 remains lodged adjacent to the toilet where it was inserted, it is easy to identify the source of the problem and hold the culprit accountable. Third, the only water back-up that might occur would be at the single toilet, where it will not cause much damage.

While this device was designed to solve a problem for prisons or correctional facilities, it also may be used in other environments, such as hospitals, hotels, or other facilities where this problem may occur.

Figure 10:
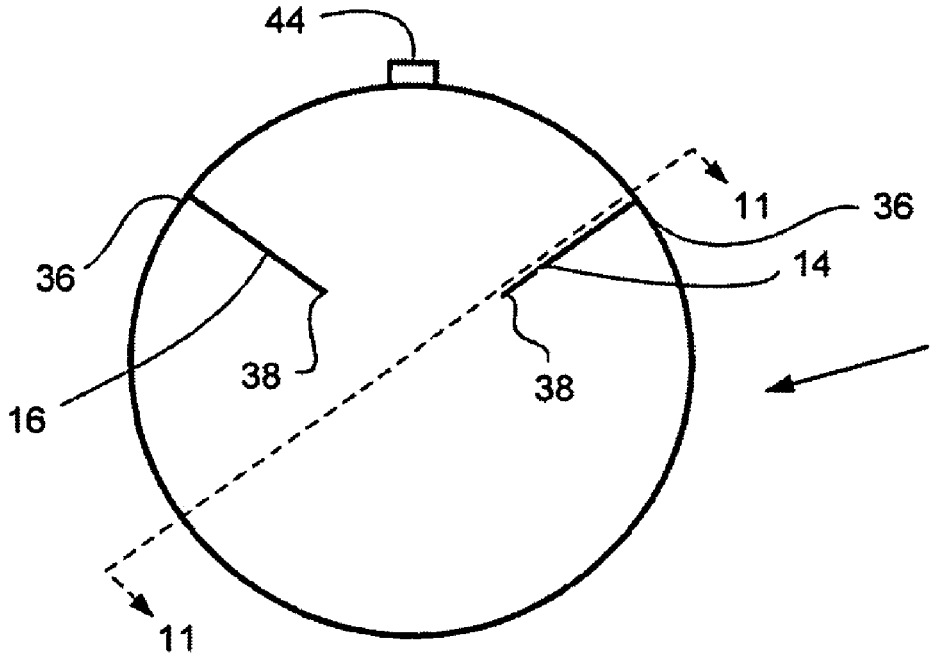
FIG. 10 is a schematic end view of the waste water line protection device of FIG. 1.

FIG. 10 is a schematic end view of the protection device 10 described above, incorporating the two spikes 14, 16 at the 2:00 O'clock and 10:00 O'clock positions, respectively, and directed at an upstream angle D of 45 degrees (with the upstream direction being opposite to the direction of the wastewater flow W) (See FIG. 11) from an imaginary vertical plane 40 extending perpendicular to the longitudinal axis 22 of the pipe 12 and through the bases 36 of the spikes 14, 16.

Each spike 14, 16 defines a base 36 which is secured to the pipe wall 12 of the protection device 10, and extends to a sharpened tip 38. In this embodiment, each spike 14, 16 has a straight line axis from the base 36 to the tip 38 and is directed upstream along its entire length. This shape of spike is preferable, because, if a toilet auger is inserted from the toilet 112, in the direction of flow of the waste water W, so as to pull out any debris 26 snagged by one or both of the spikes 14, 16, the toilet auger can then be pulled back upstream, out of the toilet 112, without concern about catching or snagging on one or both of the spikes 14, 16. However, other shapes of spikes could be used, such as curved spikes, provided that they are well-supported by the pipe wall 12 and do not create problems with catching the auger so that it cannot readily be pulled back upstream.

The protection device 10 also includes a projection 44 (See FIG. 1) on the outer surface of the pipe wall 12 in the shape of a raised arrow to serve as an indicator of the top of the device 10 and to indicate the direction of wastewater flow, in order to assist the installer in ensuring the correct orientation of the device 10 when it is being installed. If the device 10 is installed with the projection 44 on top and with the wastewater flow in the direction of the arrow, the spikes 14, 16 will automatically be in their correct orientations. Instead of a projection 44, there could be a marking, sticker, or indentation or other form of indicator on the outer surface of the pipe wall 12 to provide the same information, namely, the location of the top of the pipe wall 12 and the direction of wastewater flow.

Figure 12:
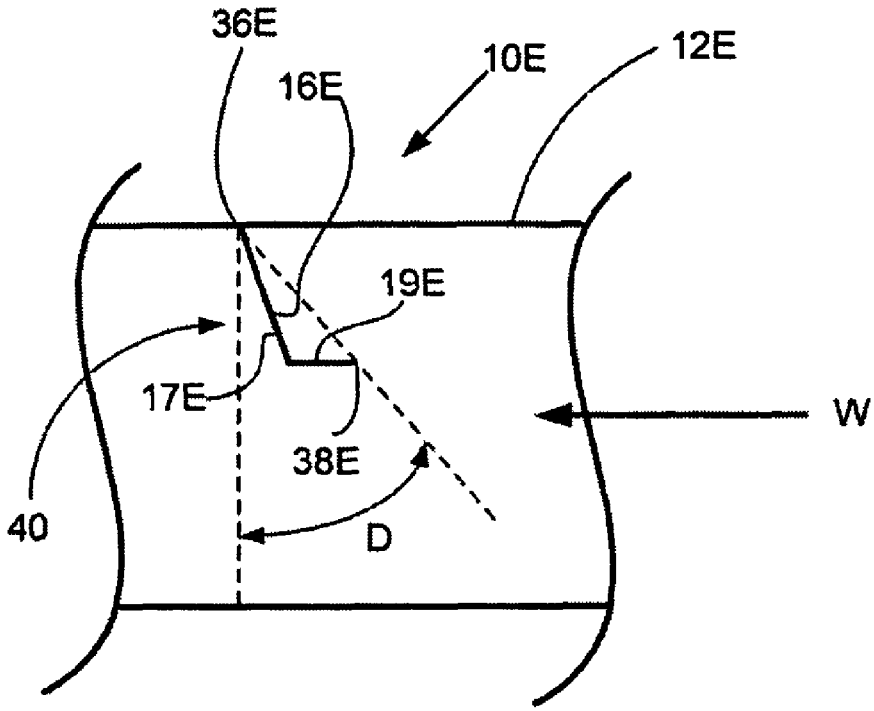
FIG. 12 is a schematic view similar to that of FIG. 11, but for yet another embodiment of a waste water line protection device.

FIG. 12 depicts another embodiment of a protection device 10E. In this embodiment 10E, there also are two identical spikes with their bases 36E at the 10:00 and 2:00 positions and lying on the same vertical plane 40, as with the previous embodiment, but the spikes have a different shape. The spike 16E is generally L-shaped, having a longer leg 17E and a shorter leg 19E, both of which are directed in the upstream direction for their entire length, so they will not snag an auger that is being used to remove the debris that is caught on them. The upstream angle D from the base 36E to the tip 38E is the same as in the first embodiment. The shorter legs 19E extend directly upstream, parallel to the longitudinal axis of the pipe wall 12E. An end view of this embodiment is essentially the same as the view in FIG. 2, except that the diameter of the long legs 17E remains constant, and the taper on the spikes is on the shorter legs 19E, which taper toward the sharply pointed tip 38E. The angle C between the bases 36E of the spikes is the same as in the first embodiment, as is the angle C between the tips 38E of the spikes.

Figure 13:
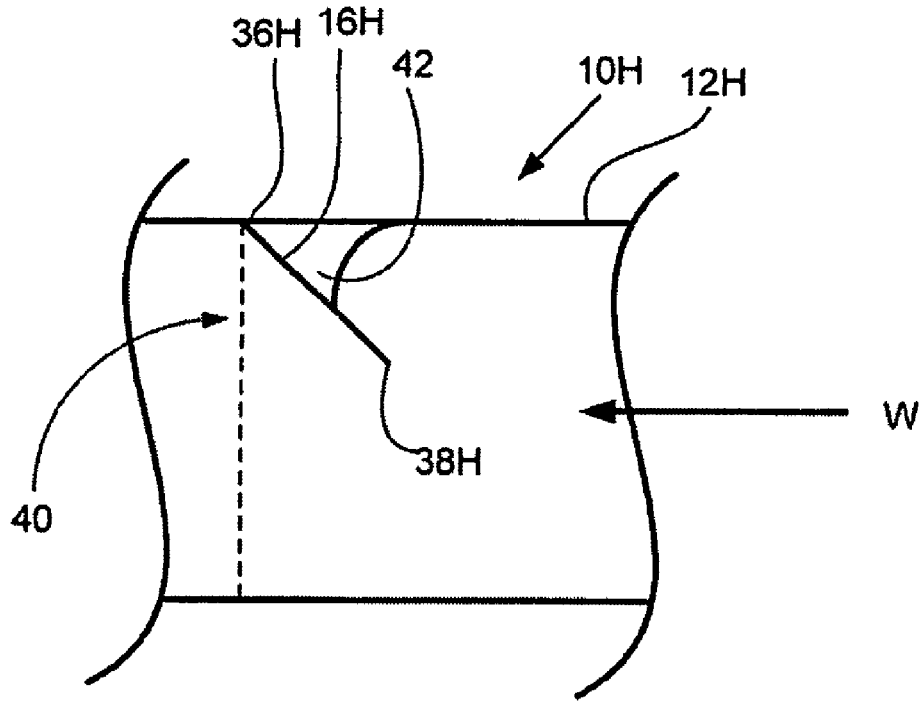
FIG. 13 is a schematic view similar to that of FIG. 11, but for yet another embodiment of a waste water line protection device.

FIG. 13 depicts yet another embodiment of a protection device 10H. This embodiment is made as a one-piece casting. This view only shows one of the spikes 16H, but again in this embodiment there are two identical spikes, and they have the same orientation as in the first embodiment and extend in a straight line from the base 36H to the tip 38H. This embodiment differs in that it includes a solid web 42 extending from the spike 16H to the inner surface of the pipe wall 12H to reinforce the spike in order to help ensure that the spike 16H will not break off when it snags a heavy, or a swiftly-flowing, piece of debris. The end portion of the spike 16H from the web 42 to the tip 38H is tapered to a point and is long enough to snag the debris, preferably at least one-half inch long.

All of the aforementioned protection devices may be installed onto the waste line 34 in a manner that is well-known by plumbers, such as by using suitable devices such as Clamp-Alls, manufactured by Clamp-All Products, 2430 East Walton Blvd., Auburn Hills, Mich. 48326.

It will be obvious to those skilled in the art that modifications may be made to the embodiments described above without departing from the scope of the present invention.

What is claimed is:

1. A device to protect waste water lines, comprising:

a pipe wall defining an upstream end, a downstream end, an inside diameter and a longitudinal axis, and having an inner surface defining a hollow interior having an upper half and a lower half;

first and second spikes projecting inwardly from first and second points on the inner surface of the pipe wall, said spikes extending from first and second bases at said first and second points to first and second free tips, respectively, each of said spikes projecting toward the upstream end of said pipe for its entire length from the respective base to the respective tip, with the upstream angle from the base of each of said spikes at the inner surface of the pipe wall to the tip being at least twenty degrees, with the angle defined between first and second radii of the pipe extending through the tips of the first and second spikes to the bases of those first and second spikes, respectively, being between ninety degrees and one-hundred thirty degrees, and with the spikes extending inwardly from the inner surface of the pipe wall a distance that is from 20% to 40% of the inside diameter, with said first and second spikes lying entirely in said upper half and with the lower half being free and open to permit the free flow of wastewater;

wherein said pipe wall is a structurally independent member that can be connected downstream of an outlet pipe which projects rearwardly from a toilet and extends through the wall of a building.

2. A device to protect waste water lines as recited in claim 1, wherein the base of each spike has a substantially larger cross-sectional area than the tip and wherein the upstream angle of each of said spikes is at least forty degrees.

3. A device to protect waste water lines as recited in claim 1, wherein the first and second tips lie substantially on the same imaginary vertical plane that is perpendicular to the longitudinal axis.

4. A device to protect waste water lines as recited in claim 3, wherein said pipe wall has a circular cross-section and has an indicator on its outer surface indicating the top of the pipe wall, and said first and second points are located at substantially the two o'clock and ten o'clock positions of said pipe wall.

5. A device to protect waste water lines as recited in claim 1, and further comprising a reinforcing web extending between the inner surface of said pipe wall and each of said spikes.

6. A device to protect waste water lines as recited in claim 1, and further comprising a toilet; a wastewater pipe extending from said toilet in a downstream direction; wherein said pipe wall is connected in line with said wastewater pipe.

7. A device to protect waste water lines as recited in claim 6, wherein said tips are located within five feet of said toilet.

8. A device to protect waste water lines as recited in claim 7, wherein said first and second points are located at substantially the ten o'clock and two o'clock positions of said pipe wall.

9. A device to protect waste water lines as recited in claim 8, wherein each of said spikes has a straight-line axis from its respective base to its respective tip and tapers from a larger cross-section at its base to a smaller cross-section at its tip.

10. A device to protect waste water lines, comprising:

a cylindrical pipe wall defining an upstream end, a downstream end, a diameter and a longitudinal axis, and having an inner surface defining a hollow interior having an upper half and a lower half, wherein the inner surface comprises the cylindrical pipe wall and first and second spikes projecting inwardly and upstream from said cylindrical pipe wall and terminating at first and second free, pointed tips, respectively;

with the upstream angle from the base of each of said spikes at the inner surface of the pipe wall to the tip being at least forty degrees, with the angle defined between first and second radii of the pipe extending through the tips of the first and second spikes to the bases of those first and second spikes, respectively, being between ninety degrees and one-hundred thirty degrees, and with the spikes extending inwardly from the inner surface of the pipe wall a distance that is from 20% to 40% of the inside diameter, with said first and second spikes lying entirely in said upper half and with the lower half being free and open to permit the free flow of wastewater; and wherein said pipe wall is a structurally independent member that can be connected downstream of an outlet pipe which projects rearwardly from a toilet and extends through the wall of a building.

11. A device to protect waste water lines as recited in claim 10, wherein said first and second spikes extend in the upstream direction for their entire length.

12. A device to protect waste water lines as recited in claim 11, wherein the first and second spikes lie entirely within the upper half of said hollow interior.

13. A device to protect waste water lines as recited in claim 12, wherein the first and second spikes project from first and second points located substantially at the ten o'clock and two o'clock positions of said pipe wall, respectively.

14. A device to protect waste water lines as recited in claim 13, and further comprising a toilet and a waste water line extending downstream from said toilet, wherein said pipe wall is located in line with said waste water line.

15. A device to protect waste water lines as recited in claim 11, and further comprising a toilet and a waste water line extending downstream from said toilet, wherein said pipe wall is located in line with said waste water line.

* * * * *

UNITED STATES PATENT AND TRADEMARK OFFICE

CERTIFICATE OF CORRECTION

PATENT NO. : 8,201,280 B1
APPLICATION NO. : 12/406672
DATED : June 19, 2012
INVENTOR(S) : Harry Barnett Nally, Jr.

It is certified that error appears in the above-identified patent and that said Letters Patent is hereby corrected as shown below:

Column 1, line 18, delete "Waste" and insert therefor --waste--.
Column 1, line 38, delete "View" and insert therefor --view--.
Column 1, line 39, delete "in a prisons" and insert therefor --in a prison--.
Column 2, line 20, delete "(see FIG. 11). it is" and insert therefor --(see FIG. 11). It is--.
Column 2, line 49, delete "from" and insert therefor --free--.

Signed and Sealed this
Thirty-first Day of July, 2012

David J. Kappos

David J. Kappos
*Director of the United States Patent and Trademark Office*